US006769424B2

(12) United States Patent
Perrault

(10) Patent No.: US 6,769,424 B2
(45) **Date of Patent: *Aug. 3, 2004**

(54) HEATER WITH HEAT RESISTANT ANTI-OXIDANT COATING ON INTERIOR SURFACES

(76) Inventor: Charles James Perrault, 2236 Mount Forest Drive, Burlington, Ontario (CA), L7P 1J1

( * ) Notice: Subject to any disclaimer, the term of this patent is extended or adjusted under 35 U.S.C. 154(b) by 0 days.

This patent is subject to a terminal disclaimer.

(21) Appl. No.: 10/356,601

(22) Filed: Feb. 3, 2003

(65) Prior Publication Data

US 2003/0111071 A1 Jun. 19, 2003

Related U.S. Application Data

(63) Continuation-in-part of application No. 09/868,728, filed on Jun. 21, 2001, now Pat. No. 6,546,926.

(51) Int. Cl.[7] ..... F24C 1/14

(52) U.S. Cl. ..... 126/77; 126/65; 126/60; 126/83

(58) Field of Search ..... 126/64, 65, 77, 126/60, 66, 83, 528, 529, 530, 531, 80

(56) References Cited

U.S. PATENT DOCUMENTS 3,922,138 A * 11/1975 Biddle et al. ..... 431/193
4,121,561 A * 10/1978 Cote ..... 126/65
6,546,926 B1 * 4/2003 Perrault ..... 126/77

* cited by examiner

*Primary Examiner*—James C. Yeung

(57) ABSTRACT

A heater for burning fuel having a hollow enclosure with an air inlet, and a combustion gas outlet. The enclosure has an exterior heat exchange wall preferably directly exposed to ambient air and an interior surface defining a combustion chamber. The enclosure has a body with front and rear openings into which are fitted a front panel and a rear panel defining joints therebetween. The interior surface of the enclosure is coated and joints are sealed with heat resistant anti-oxidant material, for example: porcelain enamel, having a co-efficient of thermal expansion not substantially greater than the co-efficient of thermal expansion of the enclosure.

12 Claims, 12 Drawing Sheets

HEATER WITH HEAT RESISTANT ANTI-OXIDANT COATING ON INTERIOR SURFACES

This application is a continuation-in-part of application Ser. No. 09/868,728, filed Jun. 21, 2001 now U.S. Pat. No. 6,546,926.

TECHNICAL FIELD

The invention relates to a heater, for example: a wood burning stove, with relatively thin walls and interior surfaces that are exposed to combustion gases coated with a heat resistant anti-oxidant coating.

BACKGROUND OF THE ART

Heating appliances using various hydrocarbon fuels have been used for heating air in dwellings, heating water, creating steam and many other functions. While the present invention is described herein using the example of a thin metal walled wood burning stove for heating the surrounding ambient air, it will be understood that the invention is equally applicable to many types of heating devices that burn oil, gas, pellets, corn, propane, biogases, or sawdust to heat air or liquids in domestic, commercial or industrial applications as well.

For the most part, the primary function of wood burning stoves until recently was for cooking and heating. While this is still true today, other factors have driven the design of stoves to produce heat more efficiently while discharging less of the undesirable byproducts of combustion into the atmosphere. Prior art stoves have traditionally had the capability of producing large amounts of heat, whilst simultaneously producing large undesirable amounts of noxious substances which were expelled into the atmosphere by the burning fuel.

In order to provide an acceptable life for most of the prior art wood burning stoves, manufacturers usually provided a metallic shell in which firebricks and/or heavy iron castings were formed and fitted into a firebox in order to protect and shield the inner surface of the outer metallic shell of the stove from the burning fuel. The resultant stove tended to be quite massive, slow to heat and difficult to move. Because of the massiveness of these stoves, considerable heat energy is required just to raise the temperature of the stove to the desirable operating temperature.

Recently stove manufacturers resorted to producing an "airtight" stove which limited the amount of combustion air allowed to the firebox so that a firebox filled with wood could be made to burn at a controlled rate for many hours.

Because of the lack of oxygen supplied to the burning wood, these "airtight" stoves tended to produce copious amounts of creosote and other gaseous products resulting from incomplete combustion of the burning fuel because of oxygen starvation. The low temperature of the emitted flue gas also allowed creosote and other noxious substances to be deposited in the cold chimney flue.

Continued use of these "airtight" stoves usually resulted in a chimney fire from time to time. Because of the problems associated with this type of heating appliance, environmental authorities had little choice but to introduce stringent restrictions on the types of stoves which could be sold in each jurisdiction.

In 1988 the U.S. Environmental Protection Agency introduced a set of standards for New Residential Wood Heaters under Title 40 Code of Federal 15 Regulations Part 60, which has had a great influence on the design of stoves which have been and are to be introduced into the U.S. market. The presence of these Regulations has provided stove manufacturers all over the world with a set of guidelines to measure the efficiency of any wood burning stove and the resulting production of any undesirable emitted materials produced by the stove under test during a monitored burning operation so as to enable a comparison of the test stove results against a set of given standards.

It is with a view to the production of a stove which is able to easily meet the 40 C.F.R. (60) regulations that this invention is directed.

In U.S. Pat. No. 4,941,451, a stove having a firebox which is surrounded by multiple air chambers is described. Primary air enters the front of the stove just below the door and is ducted to the top of the firebox where it is directed downwardly from a point well above the burning fire to induce combustion of the fuel in the firebox.

Cooling air for the stove also enters the stove in an opening in the bottom of the stove below the firebox floor. A fan is shown propelling air entering the opening into three separate streams.

A first stream is ducted up the back of the stove behind the firebox and across the top of the stove and out to the room via louvres.

A second stream is ducted upwardly in a pair of riser tubes to empty from a manifold above the fire but below the hollow baffle. Air leaves a secondary manifold to ignite and burn unburned gases.

A third stream enters the hollow baffle from a side space. This air cools the baffle and exits through a series of holes above the second secondary stream.

A slider type draft control adjusts the amount of primary air fed to the firebox. The secondary air is pressurized by a fan in the plenum beneath the firebox floor.

U.S. Pat. No. 4,832,000 uses separate primary and secondary airflows to improve the combustion of the fuel in the firebox. Both primary and secondary airflows are preheated.

In U.S. Pat. No. 4,665,889, a stove having a baffle and separate primary and secondary airflow paths is illustrated. The primary air is not really heated, but the secondary air is heated during its passage through the secondary duct work.

The objects of the invention will be apparent from review of the disclosure, drawings and description of the invention below.

DISCLOSURE OF THE INVENTION

A heater for burning fuel having a hollow enclosure with an air inlet, and a combustion gas outlet. The enclosure has an exterior heat exchange wall exposed to ambient air and an interior surface defining a combustion chamber. The enclosure has a body with front and rear openings into which are fitted a front panel and a rear panel defining joints therebetween. The interior surface of the enclosure is coated and joints are sealed with heat resistant anti-oxidant material, for example: porcelain enamel, having a co-efficient of thermal expansion not substantially greater than the co-efficient of thermal expansion of the enclosure. The enamel used should be a pyrolytic enamel as opposed to architectural enamels which cannot withstand the high temperatures of the firebox.

This invention is directed to a stove which is extremely lightweight (in comparison to the heavy stoves of recent vintage) and typically uses sheet steel as the basic material for forming an enclosure for a typical stove fire box. The interior of the sheet material forming the firebox is preferably coated with a layer of a pre-selected material which is resistant to break down due to exposure to high temperature and the products of combustion present in a firebox. The sheet steel which forms the firebox of the stove of this invention is typically coated with a protective layer of a suitable heat resistant anti-oxidant coating material on the inside surface to protect the steel sheet from the effects of exposure to the high temperatures existing in a firebox and the combustion byproducts produced therein. The sheet steel is typically a mild steel with low carbon content which lends itself to the heat resistant anti-oxidant coating process which must be carried out in an oven at temperatures approaching 1540° F. The heat resistant anti-oxidant coating may selected to be a high temperature pyrolytic porcelain enamel or glass which contains a small amount of titanium (up to about 8%) which tends to have the effect of making the interior heat resistant anti-oxidant coating surface of the firebox self cleaning. The heat resistant anti-oxidant coating and the metallic sheet steel base material must have complementary co-efficient of expansion that are selected in order that the heat resistant anti-oxidant coating steadfastly adheres to the base material during the many temperature excursions to which the heat resistant anti-oxidant coated sheet steel will be subjected over the life of the stove. A variation in the choice of metal for the substrate will usually dictate a corresponding variation in the coating to ensure that the coating is not subjected to excessive residual tension or residual compression as the metal substrate and the coating cool after firing or plasma arc deposition is completed.

The stove is provided with primary and secondary inlet air passages which are designed specifically to control the quantities of primary and secondary invitiated air allowed to enter the combustion chamber of the stove during a normal combustion process. The secondary inlet air is ducted through passages in the stove which are placed so as to be in excellent heat transfer relationship with the burning fuel in the combustion chamber of the stove so as to efficiently heat the air in the duct work to a temperature approaching or matching that existing on the combustion chamber of the stove.

The primary air (unheated) enters the stove above the access door and is ducted downwardly so as to sweep downwardly against the inside surface of the glass on the access door. This tends to prevent any buildup of smoke particles on the glass in the door. Because of the difference in density of the cold inlet air and the hot air near the burning fuel, the inlet air tends to make its way to the bottom of the firebox to promote primary combustion.

The stove of this invention is provided with a forwardly extending baffle which extends from the rear of the combustion chamber and which is fastened into the combustion chamber at each side of the baffle to the interior of the stove at some distance beneath the exhaust vent. This baffle prevents the hot air produced during the burning process from exiting directly from the fire into the exhaust vent and up the flue. Because the hot gases produced by pyrolysis must linger longer in the hot combustion chamber, the chances for ignition of these gases to occur is much greater in the presence of the baffle.

The secondary air enters the stove through a draft control (at the front of the stove) and passes through a heat exchanger duct or preheat heat exchanger to the rear of the stove which allows the secondary air to undergo a preheating operation during its passage to the rear of the stove. This preheated air next enters a heat exchanger (at the back of the stove) where the air passing through the heat exchanger is heated to a temperature approaching the maximum temperature in the rear combustion chamber wall. This heated air is allowed to exit from the heat exchanger from preferably two sets of exit ports.

Some of the heated secondary air exits the heat exchanger of the stove from exit ports formed in the heat exchanger just below the point of intersection of the baffle. The balance of the secondary air may be ducted forwardly in the stove toward the front of the combustion chamber in a duct associated with the baffle and which is provided with suitable exit ports in the baffle so that heated air is expelled from these exit ports near the front of the stove.

It is the combination of the admittance of these predetermined volumes of primary and secondary air in the presence of the baffle which determines the efficiency and the U.S.E.P.A. rating of the stove during a burning operation.

Prior art stoves, resulting from their higher insulating value during monitored burning operation, have significantly higher flue gas temperatures, resulting in lower heating efficiencies than that produced by the present invention while simultaneously meeting safety and low emissions criteria.

In a first embodiment of this invention, there is provided a wood-burning stove having a combustion chamber which is the general shape of a barrel resting on its side. The interior surfaces of the stove which are exposed to the hot exhaust gases are coated with a suitable heat resistant anti-oxidant coating such as high temperature resistant pyrolytic porcelain enamel or glass material. The rear and bottom walls are specially designed closure members for high efficiency and low emissions. The front closure member has an opening formed therein for providing access to the combustion chamber. The rear closure member is formed into a heat exchanger. The above structure is supported on a base which is incorporated into the structure, and which is provided with a set of legs. The combustion chamber is provided with a baffle to control the flow of the hot gases before exit through the exhaust vent.

DESCRIPTION OF THE DRAWINGS

In order that the invention may be readily understood, three embodiments of the invention are illustrated by way of example in the accompanying drawings.

FIG. 11 shows a second embodiment with optional tubular preheat heat exchanger, whereas

FIG. 1 is a perspective view of a wood stove in accordance with a first embodiment of the invention.

FIG. 2 is an exploded view of the front closure assembly of the stove of FIG. 1.

FIG. 3 is an exploded view of the rear closure member of the stove of FIG. 1.

FIG. 4 is a partial sectional perspective view of the stove of FIG. 1.

FIG. 5 is a side elevation sectional view of the stove of FIG. 1 showing the primary, secondary and tertiary airflow patterns.

FIG. 6 is a top partial sectional view of the stove of FIG. 1.

FIG. 7 is a representation of the airflow in the rear chamber formed in the stove of FIG. 1.

FIG. 8 shows a perspective view of a heat sink fin.

FIG. 9 shows a perspective view of an alternate heat sink fin.

FIG. 10 shows a sectional view of the stove-baffle interface.

FIG. 11 shows a perspective view of a second embodiment of the invention with optional tubular preheat heat exchanger in the bottom of the combustion chamber.

FIGS. 12–13 show front and rear portion respectively of an exploded perspective view of a third embodiment with variations in the door with primary air inlet ports in a top edge, access opening reinforced with a peripheral flange, heat exchanger with central domed portion and bottom heat shields beneath the cylindrical shell.

Further details of the invention and its advantages will be apparent from the detailed description included below.

DETAILED DESCRIPTION OF PREFERRED EMBODIMENTS

Figure 1:
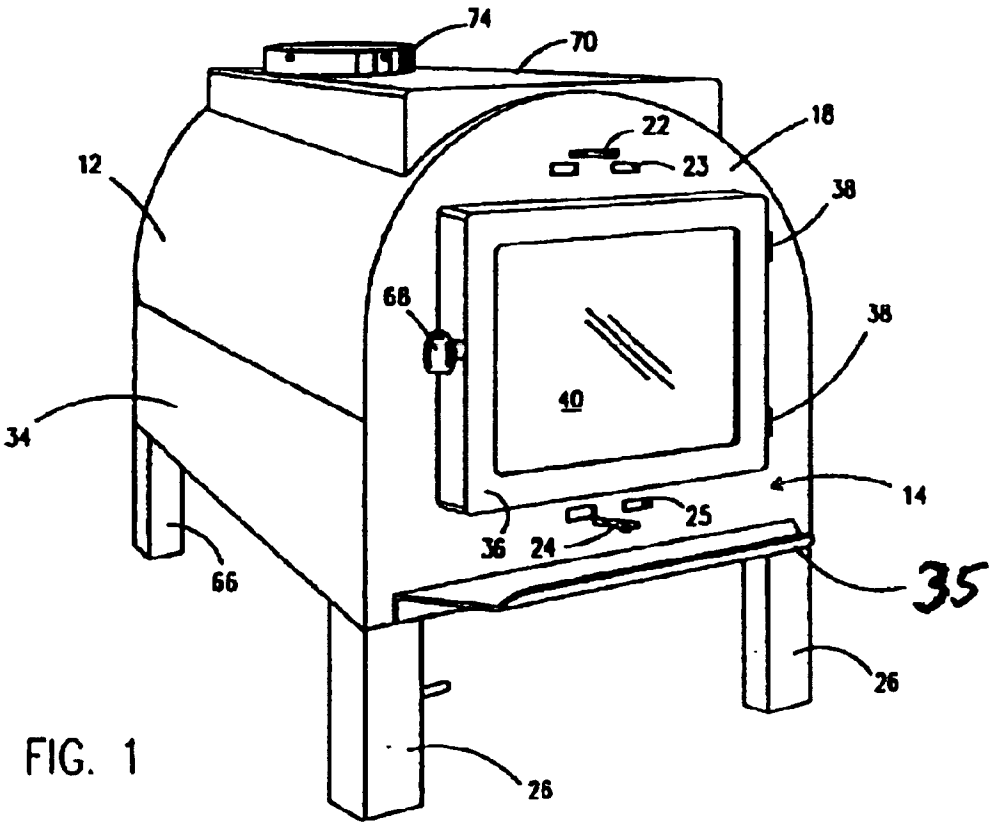
FIGS. 1–10 show a first embodiment of the basic invention.
Figure 2:
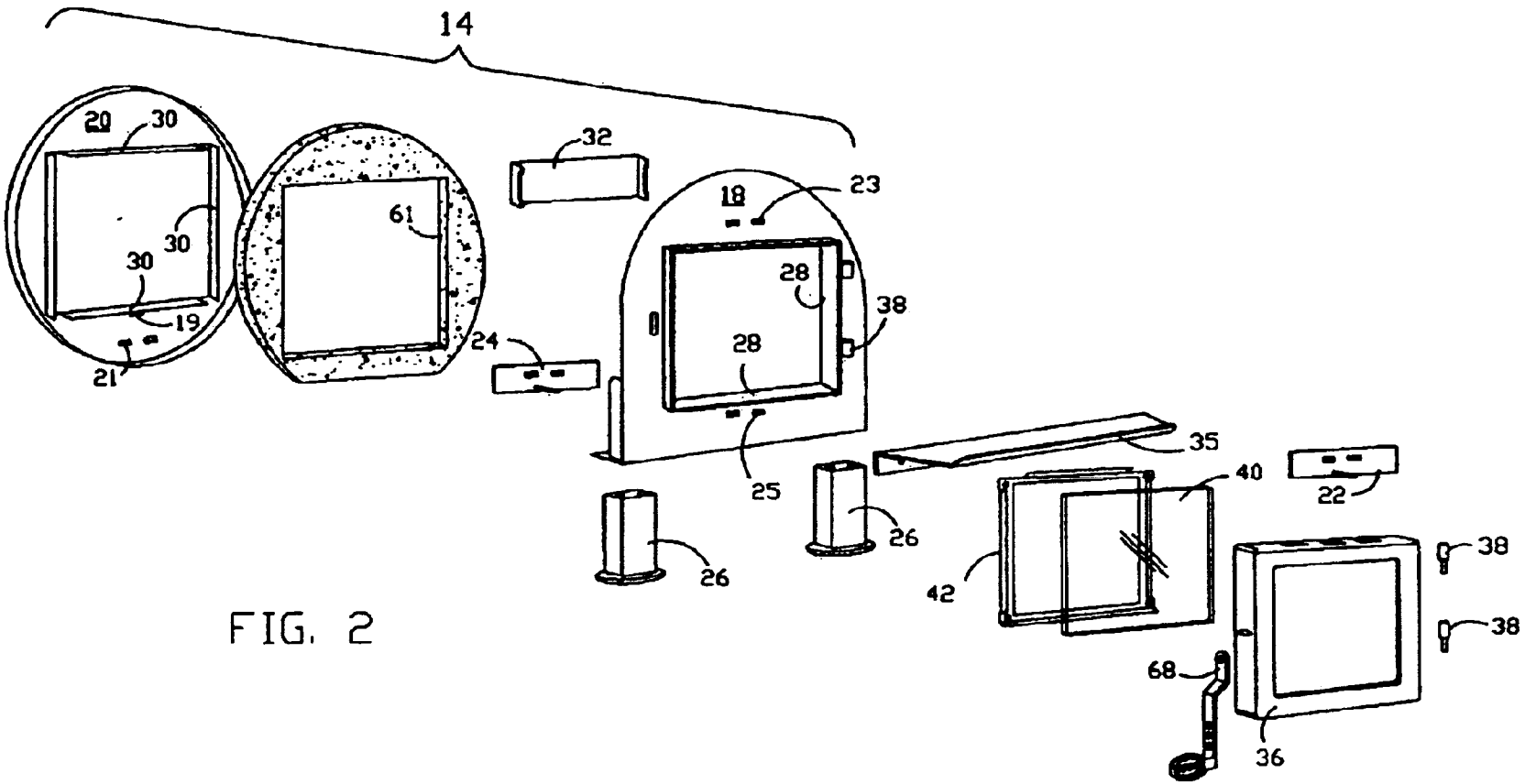

The first embodiment of the invention by way of an example stove 10 is shown in perspective in FIG. 1. The stove 10 comprises a combustion chamber shell 12 (or firebox) which is sealingly attached to a front closure member 14 and a rear closure member 16 (not shown in FIG. 1). The front closure member comprises a front outer panel 18 which is attached to inner panel 20 (see FIG. 2). Front closure member is a composite structure which provides closed passages for admission of primary air 1 and secondary air 2 into the combustion chamber 82 formed within the shell 12. A primary air draft control sliding damper 22 controls the flow of primary air 1 and a secondary air draft control sliding damper 24 controls the flow of secondary air 2 into the combustion chamber shell 12.

Front outer panel 18 provides a framework to which front legs 26 are attached to support the front portion of the stove.

The front outer and inner panels 18 and 20 are provided with flanges 28 and 30 respectively which may be welded or otherwise joined together to form a closed composite assembly. Sliding dampers 22 (primary) and 24 (secondary) are assembled into the composite before final assembly takes place. Damper 22 is enclosed in a closed box formed by member 32 within front closure member 14.

A pair of side shields (may or may not be required) 34 are attached at one end to front closure member 14 and rear closure member 16. An ashtray 35 (may not be necessary) is also attached to front closure member 14.

A door 36 is hinge mounted on front closure member 14 on hinges 38. Door 36 has a glass 40 (in this instance) held in place by door frame bracket 42.

Figure 3:
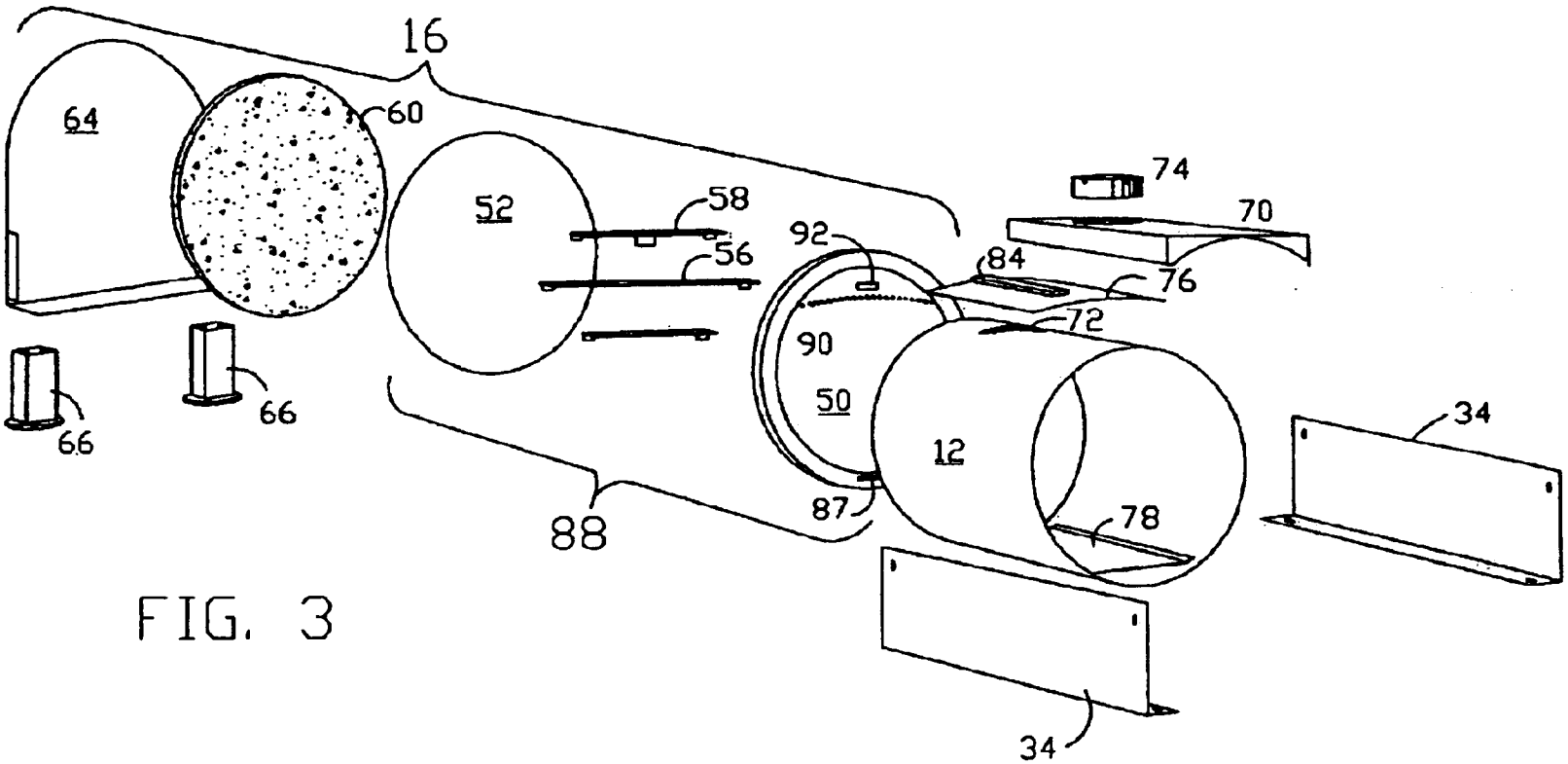

FIG. 3 shows an exploded view of the rear closure member 16 and combustion chamber shell 12. Rear closure member 16 is also a composite, comprising an inner plate 50 and an outer plate 52 which are joined together at their peripheries in a sealed fashion by press fitting, and/or spot welding to form a heat exchanger 88 which defines an internal chamber. A series of fins 56, 58 are mounted in the heat exchanger 88 as will be described later.

An optional insulation disc 60 is mounted in intimate contact with the outer surface of rear outer plate member 52 to retain heat within the air circulating in the heat exchanger 88 and to shield any adjacent walls or structures from excessive heat radiating through the back of the stove 10. A rear frame member 62 may also have an optional heat shield 64 that serves to retain heat, structurally support the combustion chamber shell 12 and the rear closure member 16 on rear legs 66.

Lastly, combustion chamber shell 12 supports a "flat top" 70 on the top thereof, and has an flue aperture 72 formed therein in which collar 74 is fitted so as to form an exhaust gas vent in combustion chamber shell 12.

Figure 6:
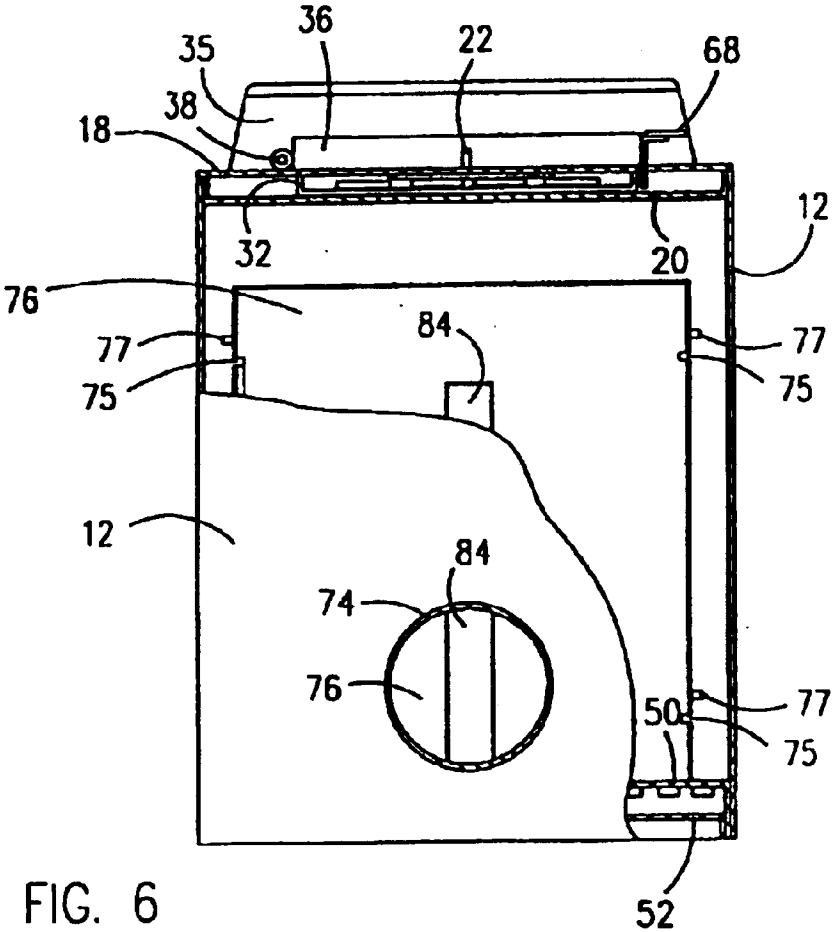

A baffle 76 (see FIGS. 4 and 6) is installed in the combustion chamber shell 12, preferably after interior coating of the combustion chamber 82 and the baffle 76 with a heat resistant anti-oxidant coating such as pyrolytic porcelain enamel. In this instance the baffle 76 is removably mounted on a plurality of projecting abutments 77 (seen in FIG. 6) formed in the inside of combustion chamber shell 12 which retain the baffle 76 in its installed position. Baffle 76 is provided with a plurality of recesses 75 to allow easy installation of the baffle 76 in the combustion chamber shell 12.

A floor 78 is sealingly mounted in the lower region of combustion chamber shell 12 to define a preheat heat exchanger 86, described in detail below.

Referring specifically to FIG. 1, door 36 is shown mounted on hinges 38 to cover the aperture formed in front closure member 14 for fuelling the stove 10 and removing the ashes produced in combustion chamber of stove 10 therefrom. The front closure member 14 and the rear closure member 16 when assembled with shell 12 provide an enclosed combustion chamber 82. The side heat shields 34 are mounted on the two closure members 14 and 16 so as to provide air flow clearance between the combustion chamber shell 12 and shields 34 to permit convection air to flow there between. The convection air flow about the external surface of the combustion chamber shell 12 simultaneously cools the relatively thin metal shell 12 (preventing heat distortion, and loss of structural strength), maintains the temperature of the heat resistant anti-oxidant coating 13 at an acceptable level (about 400° F. below firing temperature for porcelain enamel) and shields adjacent floors, walls or furniture from excessive radiant heat exposure.

Figure 4:
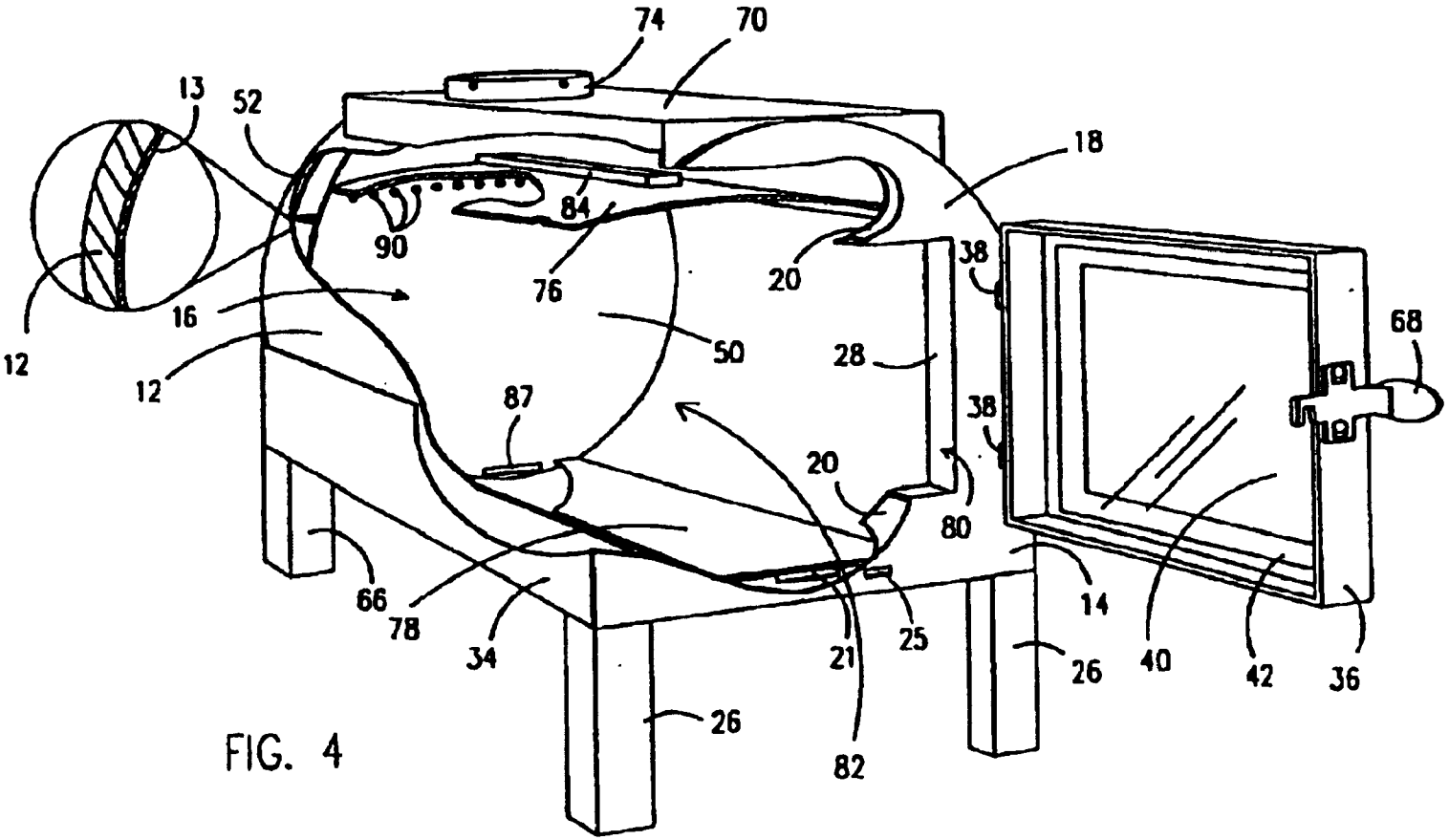

Referring now specifically to FIG. 4, the various parts of the stove are shown in a partly sectioned perspective view of the stove 10. Here the opening 80 into combustion chamber 82 is clearly shown. The composite construction of front closure member 14 is also clearly shown, slider dampers 22 and 24 having been omitted for clarity. Ports 21 and 25 are shown in closure member 14.

Floor 78 is sealed into combustion chamber shell 12 as well as to front and rear closure members 14 and 16.

The inner plate 50 of rear closure member 16 is clearly shown as is a portion of outer plate 52. Baffle 76 is shown mounted in combustion chamber shell 12.

A series of ports 90 are shown in inner plate 50 to permit the escape of heated air into combustion chamber 82 from the rear closure member 16. A duct 84 is shown mounted on baffle 76.

FIG. 4 shows the enlarged view of a section of the combustion chamber shell 12 having a heat resistant anti-oxidant coating 13 formed thereon. (The thickness of the coating 13 is typically 6 to 12 thousandths of an inch.)

Figure 5:
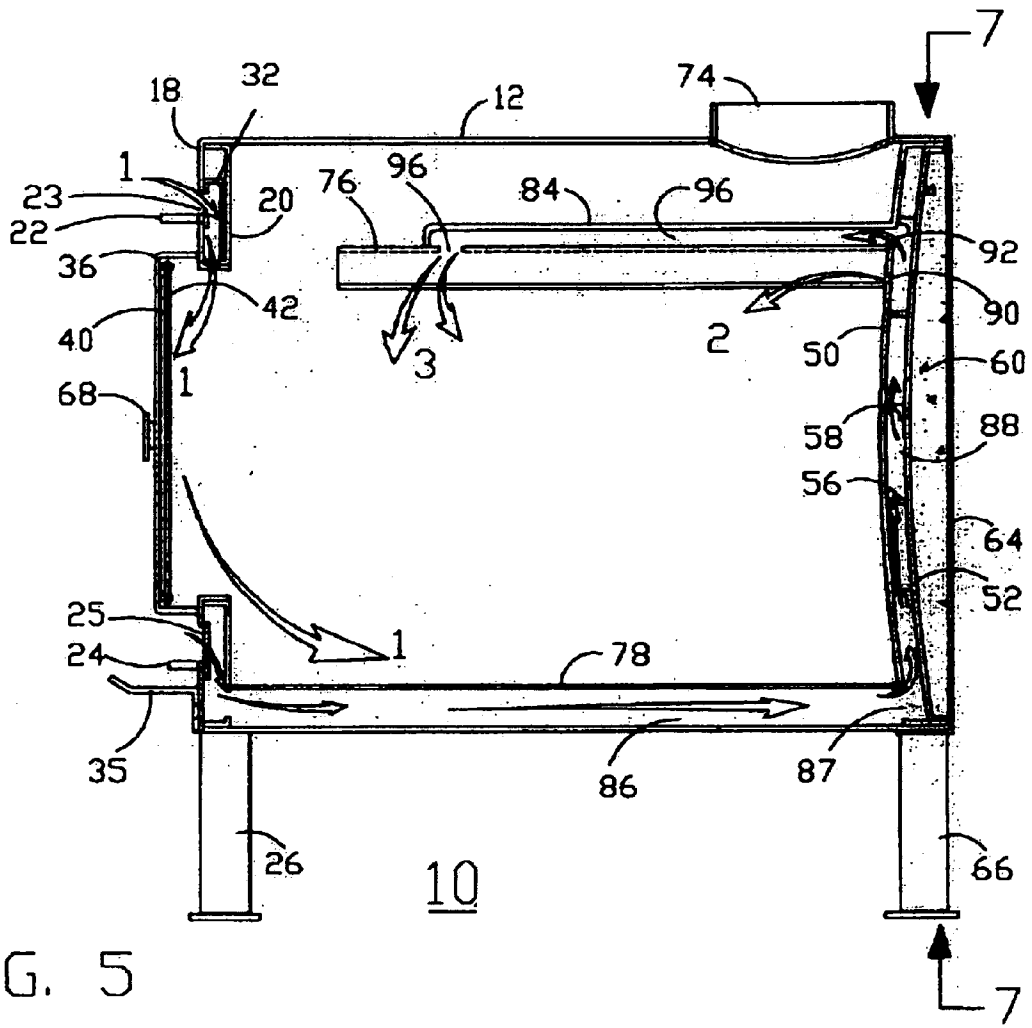

FIG. 5 shows the primary air flow 1, secondary air flow 2 and tertiary air flow 3 in the combustion chamber 82 of the stove 10.

Primary air 1 enters front closure member 14 through ports 23, past sliding damper 22 and down through ports in upper flange 28, 30 of door opening 80 to enter the combustion chamber 82 just above door glass 40. The cold primary air 1 sweeps downwardly past glass 40 and curves toward the burning fuel in combustion chamber 82 to provide oxygen for the burning of the fuel.

At the same time secondary air flow 2 and tertiary air flow 3 is admitted into ports 25 in front closure member 14 and past slider damper 24 through ports 21 in inner panel 20 of front closure member 14 to enter a preheat heat exchanger 86 formed beneath floor 78 and above the shell 12. As this secondary air 2 travels through preheat heat exchanger 86 it is heated by the burning fuel. Preheat heat exchanger 86 ends at port 87 in inner plate 50 of rear closure 16. The heated air leaves preheat heat exchanger 86 and enters into the heat exchanger 88 formed between plates 50 and 52 of rear closure member 16. Here inner plate 50 forms part of the combustion chamber 82 and thus is deliberately exposed to intense heat from the burning fuel in the combustion chamber 82.

The preheated air passes from preheat heat exchanger 86 and into port 87 of heat exchanger 88 and gathers more heat during passage there through. Secondary heated air 2 exits at ports 90 formed in plate 50 near the top of the combustion chamber 82 and passes into the upper part of combustion chamber 82 (as best seen in FIG. 5).

Tertiary heated air 3 passes through port 92 in plate 50 into duct 84 and through ports 96 to exhaust into combustion chamber 82.

The construction of the heat exchanger 88 of rear closure member 16 as shown in the exploded view FIG. 3 will now be described in detail. Plates 50 and 52 are joined at the outer periphery to form an enclosed heat exchanger 88 (as best seen in FIG. 5). The plates 50 and 52 are preferably formed as domed surfaces of revolution (similar to bottom closure members in commercial hot water tanks).

Figure 8:
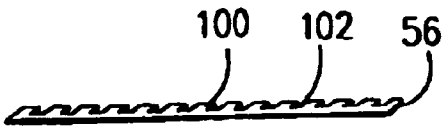
Figure 9:
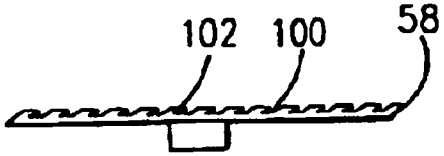
Figure 7:
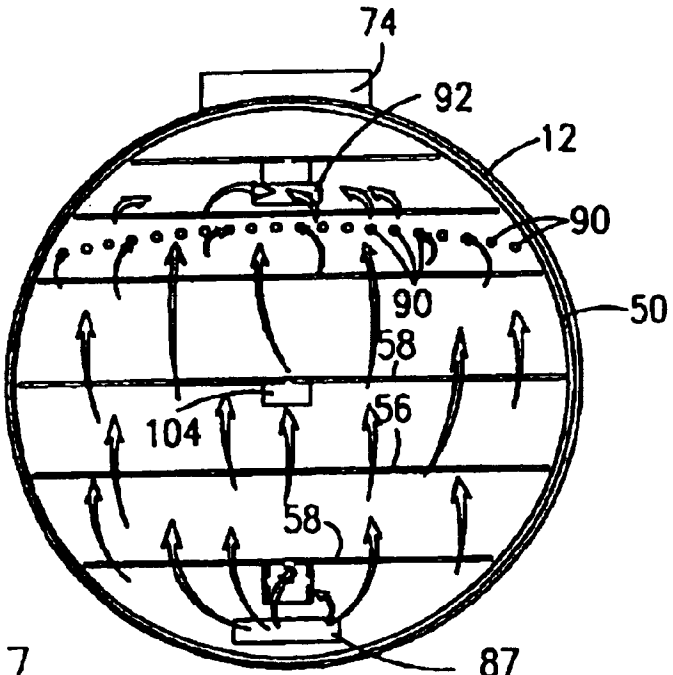
Figure 10:
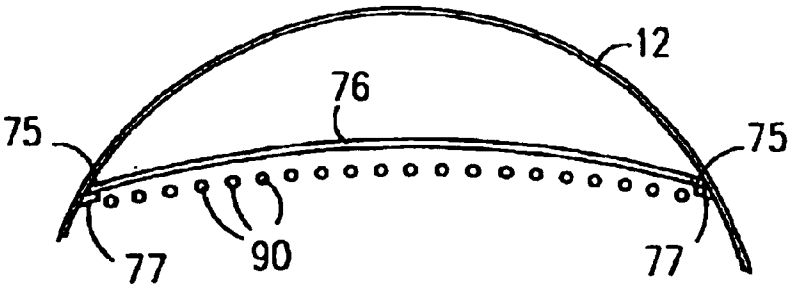

The convex side of inner plate 50 (exposed to the burning fuel) presents a large curved somewhat spherical convex surface facing combustion chamber 82. (Note that because of the shape chosen for plate 50, the curved outer surface possesses a much larger area for absorption of heat from the burning fuel than a flat plate in a similar position.) Between plates 50 and 52 are mounted a series of heat transfer fins 56 and 58 shown in FIG. 3, but in much greater detail in FIGS. 8 and 9.

Fins 56 and 58 may be curved to match the surface contour of heat exchanger 88 and are provided with teeth 100 which are separated by recesses 102. In the scheme shown the heat transfer fins 56 and 58 are provided with teeth 100 of equal width interrupted by a series of substantially identical recesses 102 there between. The fins are suitably fastened (by spotwelding) to plate 50 at the intersection of each tooth 100 with the chamber side of plate 50. It is essential the fins 56 and 58 be in excellent heat transfer relationship in plate 50. The surface of plate 52 is made to match the surface of plate 50 and each of the fins 58 which are provided with tabs 104 are plug welded to plate 52. In the construction shown in this application, plate 50 is provided with a peripheral lip 106 (see FIG. 5) which is press fitted or welded into the combustion chamber shell 12. Similarly, plate 52 is provided with a peripheral lip 106 which is press fitted or welded into lip 106 of plate 50.

The heat exchanger 88 improves the overall performance of stove 10 significantly. Invitiated air leaving heat exchanger 88 at the secondary air exhaust ports 90 has acquired sufficient heat during passage through heat exchanger 88 to achieve a temperature as close as possible to the temperature of the combustion chamber wall 50. Heat exchanger 88 is especially designed so that air entering port 87 in the lower region of plate 50 is allowed to steadily decrease in velocity as it rises in heat exchanger 88 until the mid-point of travel is reached. The secondary 2 and tertiary 3 air is now steadily accelerated during the last half of the passage through heat exchanger 88 until ports 90 and port 92 are reached.

The slowing down of the air traveling through heat exchanger 88 allows the air to absorb a substantial amount of heat from the large central area of plate 50 and fins 56 and 58 so that the air exiting from ports 90 and 92 has acquired the maximum available amount of heat during passage through heat exchanger 88 to promote easy combustion of any unburned combustible gases or hydrocarbons encountered in the combustion chamber 82. Air exiting from ports 90 and 92 has been heated to facilitate the complete burning of any unburned hydrocarbons and other combustible gases which are emitted or pyrolized from the burning fuel. Typically the temperature of the heated air leaving ports 90 and 92 in an established fire in stove 10 would be from about 500 to 950° F. The surfaces of stove 10 which are exposed to the hot burning gases produced during combustion are protected with a suitable barrier of a protective material. Burning of wood or other hydrocarbon fuels releases water vapor, corrosive gases, creosote, sulfur, phosphorous and corrosive organic compounds. Some metallic coatings are commercially available i.e. aluminized steel, stainless steel, or nickel alloy coatings deposited by plasma arc spray coating methods for example, however these are relatively expensive choices for a heat resistant anti-oxidant coating. The stove of this invention preferably has a less expensive interior surface coating of a suitable heat resistant anti-oxidant coating material, such as for example porcelain enamel, ceramic or glass based coatings. The coating material must have an expansion co-efficient which complements the steel or metal substrate on which it is to be deposited in order to prevent cracking, crazing and peeling; the heat resistant anti-oxidant coating should also possess good heat transfer characteristics. A variation in the choice of metal for the substrate will usually dictate a corresponding variation in the coating to ensure that the coating is not subjected to excessive residual tension or residual compression as the metal substrate and the coating cool after firing is completed. Careful matching of the coefficients of thermal expansion for the metal substrate and the coating are within the general knowledge of those in the porcelain enamel coating and other protective coating art.

It is generally preferable with brittle coatings such as glass and porcelain enamel, to ensure that the coating layer is in slight compression after firing since brittle coatings are weaker in tension while stronger in compression. When the metal assembly has porcelain enamel coating applied, the coated assembly is then fired at an elevated temperature. The coating partially liquefies at the high temperature and bonds to the metal substrate. The assembly is then cooled, and the metal with coating contracts during cooling. It is preferable to retain some residual compression to compress the brittle coating slightly after cooling. Therefore the metal substrate should contract to a greater degree than the porcelain enamel coating i.e.: the co-efficient of thermal expansion of the porcelain enamel coating should be somewhat less than the co-efficient of thermal expansion of the metal substrate to achieve a residual compression in the coating. Of course a high degree of residual compression would be undesirable since it would over compress the coating and lead to failure in compression, cracking or crazing of the brittle coating.

Variations in the thickness of the metal substrate, sharp corners, thicker welded connections or reinforcing ribs, for example can significantly effect the uniformity in the application of coating, control of heat distribution during the subsequent firing of the coating, and uniformity of properties in the final cooled porcelain coating. Therefore it is preferable to simplify the design of interior coated surfaces as much as possible to ensure uniform coating properties and avoid thickness variations or heat distribution variations. According the illustrated embodiments are simple cylindrical stoves which can be easily coated on interior surfaces with the same type of equipment currently used to spray coat cylindrical hot water heaters. The baffle 76 is separately coated on all sides and is made with recesses 75 to be separately mounted on projecting abutments 77 after coating of the interior of the stove.

The heat resistant anti-oxidant coating which has proved to be an excellent coating for this purpose is a high temperature porcelain enamel or glass having a content of titanium approaching 8%. The interior surfaces exposed to gases in the combustion chamber 82 are coated with the above heat resistant anti-oxidant coating composition or an acceptable substitute. It is usually not necessary to coat the interior of preheat heat exchanger 86 or the interior surfaces of heat exchanger 88 with the heat resistant anti-oxidant coating material since they are exposed only to incoming air not combustion products but these surfaces may in some instances be coated with a heat resistant anti-oxidant coating to preserve the surface integrity of these components if desired. Similarly heat transfer fins 56 and 58 may be heat resistant anti-oxidant coating coated (if desired) before final assembly of the rear closure member 16.

Specific details of the heat resistant anti-oxidant coating 13 and advantages of the assembly method resulting from the sealing effect of the internal coating 13 are included below.

Porcelain enamel is defined as a substantially vitreous or glassy inorganic coating bonded to metal by fusion at a temperature above 800° F. Suitable metal substrates are usually decarburized steel of reduced carbon content. Porcelain enamels are relatively inert inorganic oxides fired at high temperature to bond to metal and provide a sealed surface. Therefore they provide an impervious surface that is highly resistant to most chemicals, acids, alkali and water, while maintaining a sealed surface at high heats safely up to 400° F. below there firing temperature in general.

The combination of the porcelain enamel coating, the metal substrate and the design of the part to be coated all contribute to the mechanical and physical properties of the porcelain enamel. However, since porcelain enamel is substantially glass, the grasslike properties of the combination are most influential.

The development of thinner coatings has increased the role of the base metal's mechanical properties, providing more flexibility, less brittleness and greater chip resistance. Porcelain enamels, regardless of thickness, provide outstanding wear resistance and abrasion resistance, while also contributing to the strength of the metal substrate.

As a rough approximation, a typical porcelain enamel on steel has about the same hardness as plate glass. The hardness of porcelain enamel does not vary greatly from one composition to another. Depending on composition, hardness of porcelain enamels range from 3.5 to 6 on Mohs scale of mineral hardness. Most porcelain enamels for steel substrates fall in the range of 4 to 5.5. Organic finishes commonly fall in the 2 to 3 range. Comparable values on the Knopp scale range from 149 to 560. The Sward rocker rating is 100, the same as plate glass.

Porcelain enamel coatings provide excellent abrasion and wear resistance, which is important for wood stove applications subject to rough treatment during operation. Porcelain enamel's resistance to wear and abrasion is due to its resistance to gouging or crushing of the underlying enamel structure, its high surface hardness, abrasion resistance, its high surface gloss and its good lubricity.

Porcelain enamels frequently provide better wear and abrasion resistance than the substrate metals. This is attested to by their use on bunker and silo discharge chutes, coal chutes, water lubricated bearings, screw conveyors and chalkboards. Sinks, lavatories, bathtubs and range tops are further examples where good abrasion and wear resistance is an important service requirement. Test reference: ASTM C448 Abrasion Resistance of Porcelain Enamels.

Lubricity of conventional glossy porcelain enamels is perhaps the highest of any known finish except the "no stick" fluorocarbons. This feature enables self cleaning or elimination of deposits in the wood stove interior.

Adhesion of the porcelain coating to the metal substrate relates to: resistance to mechanical damage by impact, torsion, bending or heat shock; attraction of enamel and metal; and a relationship to metal substrate design. Good adhesion is produced by reaction and fusion of the porcelain enamel coating with the base metal at relatively high temperatures that may fall within a broad 932 degree F. to 1652 degree F. (500 degree C. to 900 degree C.) range. Glass is very strong in compression. When the porcelain enamel coating or glass is applied to the metal substrate, preferably the formulation of the coating is such that it has a lower coefficient of expansion than the substrate and thus is always in compression. The bond has many characteristics of a true chemical bond in combination with mechanical bond developed by fusion flow of the coating over the surface roughness of the substrate. Since moisture or rust cannot penetrate beneath the porcelain enamel coating, it will not flake away from exposed edges or damaged areas. The coating does not tend to creep and porcelain enamel coated metal will flex with the metal providing resistance to stresses that cannot be obtained in solid glass.

Like glass, porcelain enamel will fracture when abused. It is difficult to predict the impact resistance of a specific porcelain enamel since it depends as much or more on the design of the part as on the properties of the porcelain enamel. However, a porcelain enamel can be very strong and flexible if applied to a properly designed part. As a general rule, porcelain enamel will not fracture due to impact unless the base metal is permanently deformed. Because of its high compressive strength, the enamel is rarely crushed at the point of impact. Porcelain enamel's compressive strength is in the range of 20,000 psi.

Thin porcelain enamel coatings have very good flexibility and adhesion when applied to thin metal substrates. For example, a 10-mil commercial steel sheet with two porcelain enamel coatings 5-mils thick is so flexible it can be shipped in 12-inch diameter coils without damage. Experimental porcelain enamels applied at a thickness of 1.5-mils to steel sheet 4-mils thick have been deformed to a radius of 1.5-inches without damage to the coating. Porcelain enamel coatings will flex with the base metal until the metal is permanently deformed. The modulus of elasticity is $10\times10^{-6}$ for porcelain enameled steel. Tensile strength is approximately the yield point of the base metal. The impression of brittleness and lack of flexibility probably stems from the fact that heavy coatings applied to thick metal articles, such as bathtubs, for example, tend to fracture when lightly bent. Thin coatings applied to thin metal substrates demonstrate improved resilience and bending capacity.

Due to low ductility and intimate bond, porcelain enamel increases base metal flexural strength and the strength of coated assemblies. The stiffening effect of the coating can be used advantageously to reduce metal thickness. The stiffening effect is more pronounced on lighter gages than on heavier gages of metal. In the present invention, the coating of a relatively thin metal shell 12 and joined plates 50, 20 significantly increases the stiffness of the coated assembly.

Though thicker porcelain enamel coatings may be used to promote needed rigidity or offer added wear protection, thinner coatings are much less vulnerable to fracture and chipping. For instance, a 0.016-inch porcelain enamel under torsion test may be expected to show failure at 50–60 degree but 0.003-inch coatings have been torsion tested to 200 degree and beyond before any fracture occurred. For metal porcelain enameled on one side only, the effect is greater when the porcelain enamel coating is on the compression side. With equal coating thickness on opposite sides of a panel, the residual compressive stresses contribute a stiffening condition desirable for rigid designs. The stove 10 of the present invention may be coated on the interior surfaces for corrosion resistance and on the outside surfaces for appearance and durability, with increased strength as a result.

Porcelain enamel can be applied in a wide range of thickness, from 1-mil or less on steel or aluminum substrates to 125-mils (⅛ inch) or more on cast iron or heavy gage steel or plate. Optimum thickness depends on compositions of the porcelain enamel coating and the base metal and on service conditions. In general, thinner porcelain enamel coatings are more flexible and have greater resistance to fracture. Thicker coatings withstand chemical attack for longer periods. The thickness of the porcelain enamel can be a factor in the mechanical strength of the product or component adding stiffness to it. For applications on steel, a base or ground coat of porcelain enamel 2 to 5-mils thick is commonly applied and followed with one or more finish coats. However, with modified pretreatment of steel substrates and decarburized steel quality, a one-coat porcelain enamel finish coat of 3 to 5 mils may be applied directly to the steel. If more than one cover coat is applied, each may be 2 to 10-mils thick. Multiple coats can be applied that interfuse to form a single heavy layer. Thickness over 15-mils is not generally recommended for sheet metal parts because of warpage or chippage problems. Normally, heavier coatings are used on cast iron or steel plate where rigidity of the substrate resists deformation and reduces the danger of fracture. Such coatings are sometimes desirable to hide rough spots on the metal or to provide longer service life.

For porcelain enamel coatings the coefficient of thermal expansion is largely determined by chemical composition. The coefficient of expansion is usually $8–14\times10^{-6}$ cm/cm/° C. formulated so glass is always in compression. Being glass-like, porcelain enamel is much stronger in compression than in tension. Hence, it is usually selected to have the coefficient of expansion of the porcelain enamel coating lower than that of the metal substrate so that in cooling the coating will be in compression, not tension. The amount of compressive stress allowed to develop must be controlled carefully. If it becomes too high, fracture can occur at sharp radii. Excessive compressive stress can increase warpage tendencies, particularly with the metal substrate coated on one side only, or having unequal coating thickness on the two sides. Test reference: ASTM C359 Linear Thermal Expansion of Porcelain Enamel and Glass Frits and Ceramic Whiteware Materials by the Interferometric Method.

Porcelain enamel is not a thermal insulator, but it is a relatively good heat conductor when applied in thin coats. In the wood stove of the invention, the good conduction of heat by the porcelain enamel coating is a beneficial feature enabling efficient transfer of heat through the walls of the stove to the ambient air.

Porcelain enamels possess excellent corrosion resistance in a variety of corrosive environments, including exposure to heat, combustion gases and corrosive wood burning fumes. Long-term weathering tests conducted by the U.S. National Bureau of Standards (NBS) and the Porcelain Enamel Institute (PEI) confirm the resistance of porcelain enamel coated metals to various atmospheric conditions including corrosive industrial atmospheres, gases, smoke, salt spray and sea coast exposure. Porcelain enamel surfaces can be readily cleaned after such exposure and changes in appearance are almost imperceptible, especially among those coatings formulated to have a high degree of acid resistance.

EXAMPLE 1

The following provides an example of a porcelain enamel coating that is suitable for application to a wood stove constructed in accordance with the present invention. A coating was prepared using Ferro™ enamel (from Ferro Corp. of Cleveland, Ohio, USA) with 20% feldspar added. Other refractory materials can be used such as silica or mica instead of feldspar. The coating was applied in a thickness of 6–8 mil to the interior firebox surfaces of a wood stove 10 and removable baffle 76. The metal substrate surfaces were cleaned of oils, welding flux or surface contaminates, and cleaned of mill scale by shot cleaning or light sand blasting if necessary. No particular cleaning was required for porcelain enamel coating beyond that normally required for paint application to metal. The coated assemblies were fired at 1540° F. for 4 minutes at high fire and then allowed to cool at room temperature. The porcelain enamel coating was subjected to wood fire within the combustion chamber measured by thermocouple to be 1350° F. at a central portion of the combustion chamber. The external surfaces of the porcelain coated sheet metal shell 12 were observed to be glowing orange colour and temperature was measured to be 1100° F. On extinguishing the fire, the porcelain enamel surface was inspected. No crazing, cracking or colour damage was observed after repeating this test 6 times. It was concluded that the external walls of the wood stove were maintained below the maximum recommended thermal stability temperature (at 1100° F. i.e.: 400° F. below the firing temperature 1540° F.) by the cooling effect of ambient air passing over the external surfaces and withdrawing heat as a result. It was concluded that the ambient air surrounding the wood stove exterior and circulating by convection was maintaining the wall temperature well below the maximum temperature in the combustion chamber. The relatively thin metal walls, good heat conductivity of the porcelain enamel coating and absence of insulation permitted efficient heat exchange with ambient air and kept the wall temperature low enough to avoid thermal instability and damage to the porcelain enamel coating.

It will be found that the heat resistant antioxidant coating coated combustion chamber shell 12 yields heat in the shortest possible time when compared to heavy prior art stoves, due to thin metal walls and heat conduction by the porcelain enamel coating. Steel sheet metal or relatively thin welded assemblies or castings are preferred for structural components due to superior heat transfer to the ambient air and much reduced cost and weight. Because there are no bricks or heavy castings used in the construction of the combustion chamber of this stove, the stove has a minimum thermal mass, thus enabling fast heat production from start-up.

The shape of stove 10 has been chosen to be as nearly cylindrical as is possible in order to achieve ease of manufacturing. Other shapes such as elliptical and polygonal are entirely possible. Generally speaking, the embodiment shown in FIG. 3 shows a generally cylindrical central combustion chamber shell 12 extending along a generally horizontal axis. It is relatively simple to fabricate and uniformly coat a cylindrical shell 12 with disc shaped rear closure member 16 with a heat exchanger 88 and front closure member 14, and high strength results from this simple cylindrical structure. The construction of rear closure member 16 has been chosen to be light and robust (fins 58 fasten plates 50 and 52 together in an assembly) so that no thermally induced buckling or "oil canning" occurs during heating up or cooling down operations that creates annoying noise and could damage the coating 13.

It may be found that in some jurisdictions the emission standards are somewhat relaxed from 40 U.S.C. Part 60. In these instances some of the components of the stove 10 may be omitted. For instance insulating disc 60 (in the rear closure assembly 16) may be omitted (which slightly reduces the operating temperature of heat exchanger 88) as well as heat shield 64 in rear closure 16 in order to simplify the stove construction.

As well, the duct 84 located on top of the baffle may be omitted from some models in countries where emission requirements are not as stringent as the U.S. The supply of hot "tertiary" air 3 at the front of the combustion chamber 82 is present to meet stiff environmental standards for present and future and to assure that any combustible products which have escaped combustion by the primary and secondary circulated air are exposed to the hot "tertiary" air 3 to promote in one last combustion attempt before such gases are released up the flue aperture 72.

Baffle 76 is provided in order to cause the hot gases to increase hot gas residence time, causing gases to linger in the combustion chamber 82 for a longer duration than would occur in the absence of baffle 76. Baffle 76 may be attached to the combustion chamber shell 12 in a number of ways, but it has been found that the baffle 76 may be held in place by four (preferably) projecting abutments 77 from the surface of the shell 12 which hold baffle 76 in place. Baffle 76 is provided with four recesses such as 75 shown in FIG. 6 which permit baffle 76 to be installed in stove 10. Recesses 75 are lined up with projections 77 and baffle 76 is bowed upwardly by pushing upwardly in the centre of baffle to position baffle 76 above abutments 77. As soon as baffle 76 is bowed upwardly between the projecting abutments 77 the necessary clearance between the baffle 76 and the surface of combustion chamber shell 12 is obtained, the baffle 76 is pushed to slide rearwardly to its "home" position abutting against plate 50. Baffle 76 is then allowed to relax to an intermediate position which spring loads the baffle against and between the projections 77. Because the baffle 76 is still bowed in an upwardly convex shape, any dimensional changes occurring in baffle 76 during start up or shut down do not produce annoying clicks and bangs due to expansion and contraction of the baffle 76 or the shell 12 in which the projections 77 holding the baffle 76 in place are formed. The curved shape of the baffle 76 assures that any distortions of the baffle 76 which occur will proceed in a predictable manner.

Figure 11:
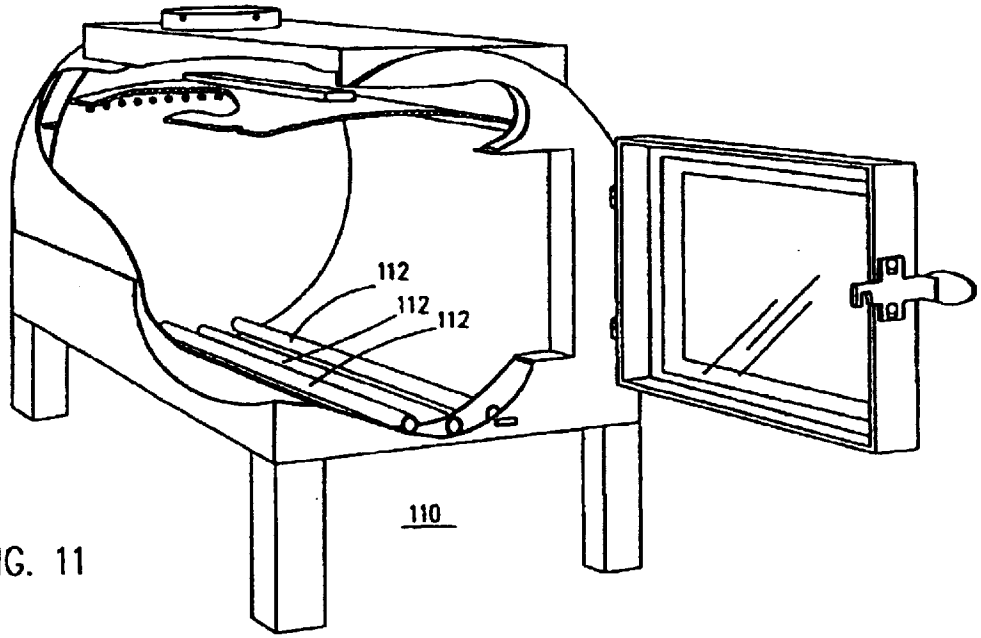

To those skilled in the art, changes and alterations will become immediately apparent once the basic design is disclosed. For instance, FIG. 11 shows an alternative second embodiment in the example stove 110 illustrated, in which the preheat heat exchanger 86 shown in FIG. 5 is replaced by a series of tubular ducts 112 in the combustion chamber on which fuel to be burned is placed. The tubes 112 function as efficiently as the preheat heat exchanger 86 (produced by floor 78 and shell 12) in performing a heat transfer to air passing through the tubes. It will be obvious to those skilled in the art that other methods of directing the secondary air are possible which still achieve the required heat absorption etc.

Heat shielding may be applied to the stove for applications where safety is a concern. Because of a variation in safety laws, a variety of shielding devices for the stove are possible. Side panels 34 and rear heat shield 64 have been included in this description but certainly other heat shields i.e. belly shield to protect adjacent floor surfaces may be included for various heating applications as the situation demands. In most instances the presence or absence of heat shield 34 would have little effect on the overall stove efficiency or the E.P.A. rating, but the shields do affect the temperature of surrounding walls, floors and objects in the immediate area of the stove 10. A long life lightweight stove 10 has been disclosed which is easy to fabricate, transport and install.

Much of the success of this stove 10 is due to the protection provided to the steel enclosure by the protective coating 13. Aluminized steel provides a measure of protection and is available commercially. However, a continuous layer of a self cleaning high temperature heat resistant anti-oxidant coating 13 such as porcelain enamel or glass on the interior surface of the combustion chamber 82 and baffle 76 is the preferred coating 13 for this application.

Heat exchanger 88 formed between plates 50 and 52 have the general shape of a Belville washer and a real advantage is gained by the production of an enlarged curved surface area of plate 50 facing the burning fuel (when compared to plate 50 if it was flat). The fins 56 and 58 must be curved to match the curving interior surface of heat exchanger 88. The teeth and recesses of the fins 56 and 58 may be varied in width to slightly increase the resistance to air flow in the centre of the heat exchanger 88, thus forcing the moving air to spread out. Door 36 of stove 10 has been illustrated with a fire viewing glass 40 installed therein. It will be obvious that door 36 may be a solid door.

Figure 12:
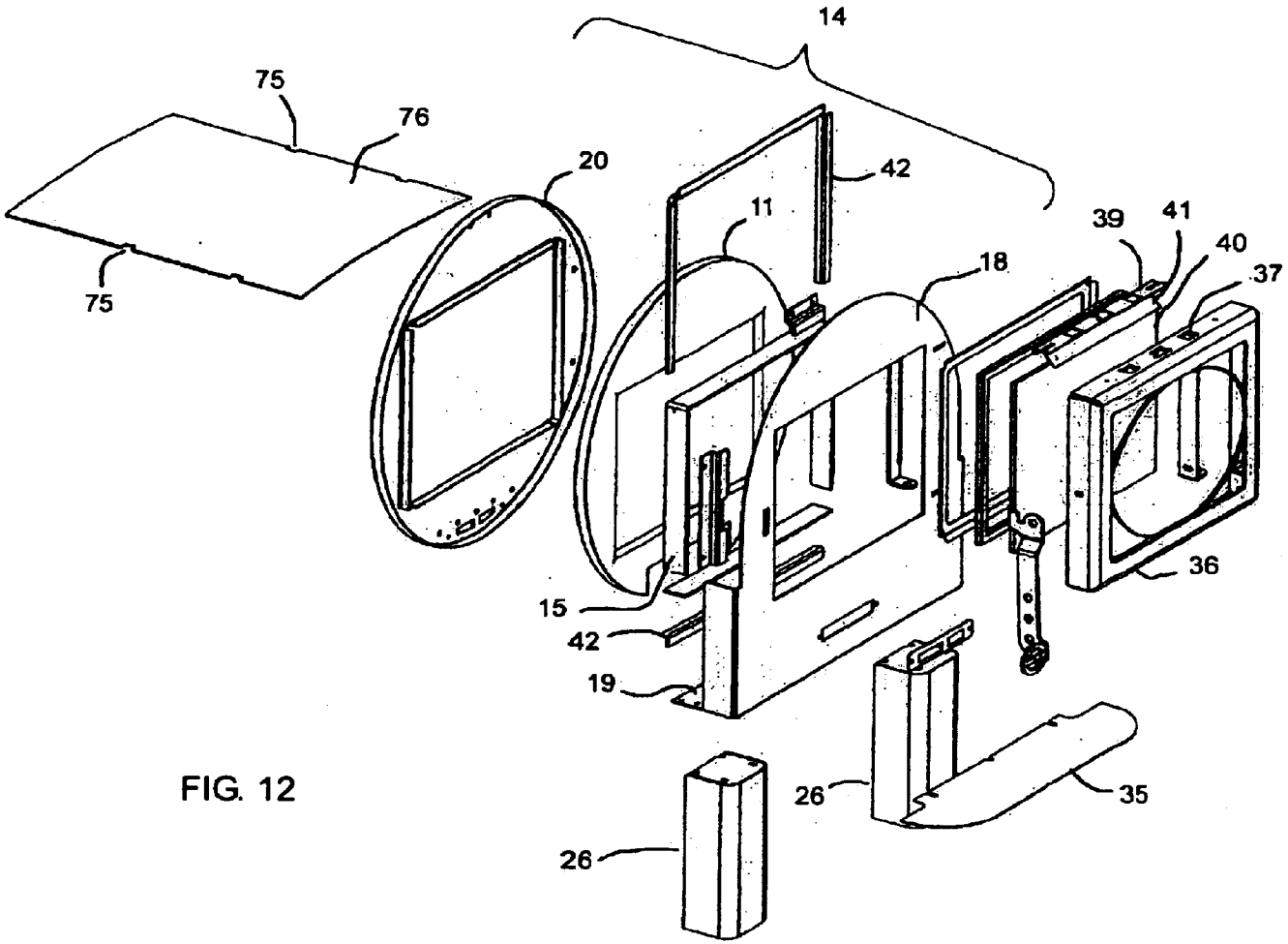
FIGS. 12–13 show a third embodiment with variations in the door, access opening, heat exchanger and bottom heat shields.
Figure 13:
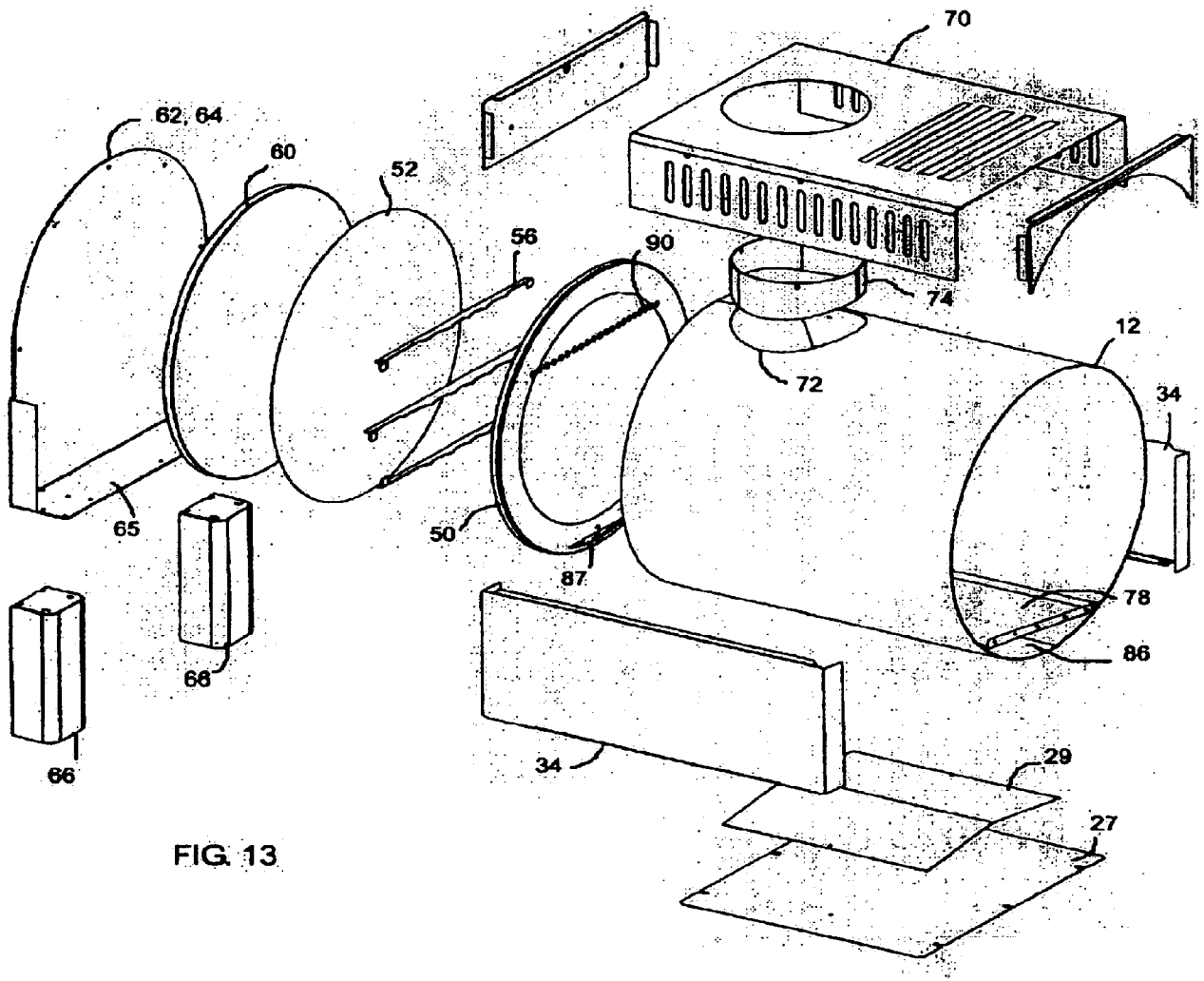

FIGS. 12 and 13 show an exploded view of a third embodiment of the invention having many of the same components with the first and second embodiments, such as the cylindrical combustion chamber shell 12, floor 78 fitted therein to create a preheat exchanger 86 extending between the front inner panel 20 and rear inner plate 50. The cylindrical collar 74 is fitted within the flue aperture 72 in a like manner. The baffle 76 is separately coated with porcelain enamel and is removably fitted into the combustion chamber 12 after completion of the coating process.

Figure 14:
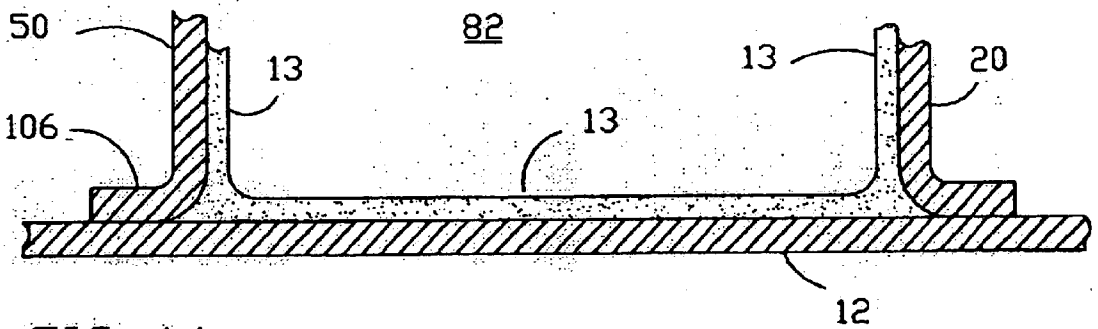
FIG. 14 is a partial axial sectional view showing the coating applied to corners formed between the cylindrical combustion chamber shell, and the front and rear panels.
Figure 15:
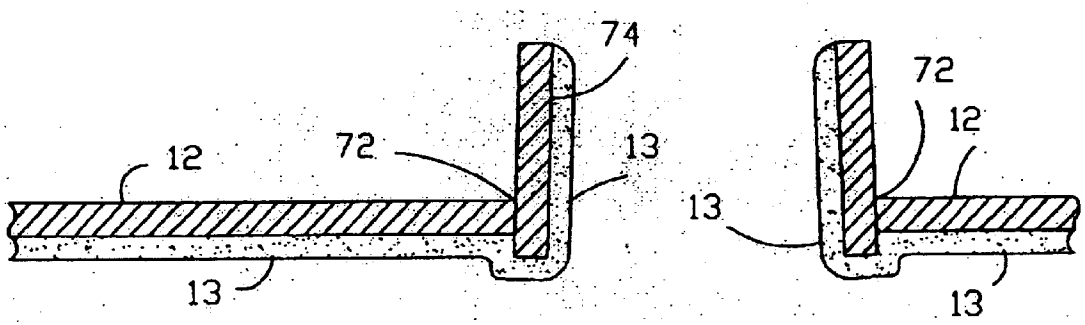
FIG. 15 is partial axial sectional view showing the coating applied to the peripheral joint formed between the cylindrical combustion chamber shell, and the flue collar 74.

With references to FIGS. 14 and 15, cylindrical combustion chamber shell 12 is press fit together with circular inner panel 20 having a peripheral flange extending outwardly and is also press fit together with rear inner plate 50 having a peripheral flange or lip 106. As shown in FIG. 15, the flue collar 74 has a slight taper, so that when it is inserted from the inside of the combustion chamber shell 12 through the flue aperture 72, a tight fit between the sheet metal component is assured.

In order to coat the interior of the combustion chamber 82, a spray nozzle is inserted through the opening and the front inner panel 20 and coating is applied to the internal surfaces using methods common to the glass coating of cylindrical hot water heaters. When the coating 13 is fired, as indicated by illustrations in FIGS. 14 and 15, the transition between parts in corner areas are flooded and covered completely with the coating 13. For example, in FIG. 14, the press fitting of inner panel 20 with peripheral flange and inner plate 50 with lip 106 ensures a tight frictional fit with the internal surface of the combustion chamber shell 12. However, the spray application and subsequent firing of the porcelain enamel coating 13 covers the corner joints adequately to protect from corrosive combustions gases. In a like manner, as shown in FIG. 15, the corner joint created at the intersection between the collar 74 and the internal surface of the combustion chamber shell 12 is completely enveloped and protected from corrosive combustion gases. Preferably, as shown in FIG. 15, the internal surface of the collar 74 is also coated as a protective measure.

It has been found therefore through experience that it is not necessary to seal weld components together by tight press fitting of components to the combustion chamber shell 12 and tack welding them in place. It is not necessary to completely seal weld components defining the combustion chamber 82 since the application of coating 13 and subsequent firing creates a sealed interior lining. The excess heat and labour involved in seal welding can be avoided. Those familiar with wood stoves will recognize that even if there are slight leakages in the joints and application of the coating 13, significant corrosion will not occur. In operation, the wood stove is constantly under a vacuum or draft condition relative to the external ambient air. Therefore, any leakage in the sealing of joints will merely result in the inflow of air into the combustion chamber 82 and will not result in significant corrosion from combustion gas exposure.

Other features shown in FIGS. 12 and 13 unique to the third embodiment are explained below. The side shields 34, ledge 65 on the rear frame 62 and corresponding ledge 19 on the front outer panel 18 support bottom heat shield 27 and deflector 29.

With respect to FIG. 12, reinforcing frame 15 reinforces the door opening and extends between the inner panel 20 and the front outer panel 18. It has been found that reinforcement by the door opening frame 15 together with insulation disk 11 prevent heat distortion such that the door 36 does not require the conventional sealing gasket to maintain a sufficiently sealed abutment between the door 36 and the front wall 18.

A further enhancement relates to the primary air 1 which in the third embodiment shown in FIG. 12 enters through ports 37 in the top surface of the door 36. A sliding damper 39 with matching openings is slidably mounted in the top edge of the door 36 to open and close the ports 37. The sliding damper 39 has a downwardly outwardly angled deflector plate 41 which serves to immediately direct the primary air flowing through the ports 37 against the window glass 40 mounting in the door 46 and maintain a clear viewing into the combustion chamber.

It will be clear as described above that the invention is not restricted to sheet metal structures but can also include welded assemblies, stampings, castings or forgings. However primary considerations in choosing the type of material for the firebox structure relate to costs involved in manufacturing, heat transfer characteristics of the porcelain enamel coating 13 in conjunction with the walls of the combustion chamber that serve to radiate heat to the ambient air.

The preferred embodiment involves relatively low cost thin sheet metal walls that are coated with low cost porcelain enamel. Any type of heat resistant antioxidant coating however performs the same function and provides the same benefits. Other heat resistant antioxidant coatings as explained above include plasma arc sprayed coatings such as nickel alloys, stainless steel coatings, aluminum alloys and ceramics, as well as sprayed and fired glass or porcelain enamel coatings.

A preferred thickness range of coating 13 is between 3 and 6 mil. However, thinner coatings may function adequately depending on the type of materials used and the specific structure of the combustion chamber. The cylindrical shape and disk shapes of the end components is optional. Rectangular combustion chambers or other shapes may be used to equal advantage. The preferred embodiments shows a cylindrical combustion chamber shell 12 simply because it is an easily fabricated low cost structure with relatively high strength. In a like manner, the domed convex shape of the inner plate 50 is optional and a completely flat or concave inner plate 50 may be used in other applications.

Although the above description relates to a specific preferred embodiment as presently contemplated by the inventor, it will be understood that the invention in its broad aspect includes mechanical and functional equivalents of the elements described herein.

I claim:

1. A heater for burning a solid fuel comprising:

a hollow enclosure with an air inlet, and a combustion gas outlet, the enclosure having at least one interior wall adjacent a combustion chamber for containing said solid fuel, wherein:

the interior wall comprising a dual layer bonded composite with a outer metal layer structurally reinforced with heat and abrasion resistant anti-oxidant inner coating layer having a co-efficient of thermal expansion not substantially greater than the co-efficient of thermal expansion of the outer metal layer.

2. A heater according to claim 1 wherein the heat resistant anti-oxidant coating layer is selected from the group consisting of: glass; porcelain enamel; pyrolytic enamel; ceramic; and corrosion resistant metal alloy.

3. A heater according to claim 1 wherein the outer metal layer is of material selected from the group consisting of: a decarburated steel; a low carbon mild steel; a sheet metal; a cast metal; a forged metal; a stamped metal assembly; and a welded metal assembly.

4. A heater according to claim 1 wherein the heat resistant anti-oxidant inner coating layer has a thickness of 2 mil to 15 mil.

5. A heater according to claim 4 wherein the heat resistant anti-oxidant inner coating layer has a thickness of 3 mil to 10 mil.

6. A heater according to claim 5 wherein the heat resistant anti-oxidant inner coating layer has a thickness of 4 mil to 8 mil.

7. A heater according to claim 2 wherein the porcelain enamel includes up to 20 percent refractory material by weight.

8. A heater according to claim 7 wherein the refractory material is selected from the group consisting of: feldspar; and silica.

9. A heater according to claim 1 comprising:

an enclosure body having front and rear openings;

a front panel and a rear panel fitted into the front and rear ends defining joints therebetween, wherein the heat resistant anti-oxidant inner coating layer covers an interior surface of the enclosure and the panels and spans between the body and panels thereby sealing said joints.

10. A heater according to claim 9 wherein the body and panels are constructed of sheet metal.

11. A heater according to claim 10 wherein the panels have peripheral flanges parallel to and engaging an interior surface of the enclosure body.

12. A method of manufacturing a heater for burning solid fuel comprising:

forming a hollow enclosure comprising a metal layer with an air inlet, and a combustion gas outlet, the enclosure having an exterior heat exchange wall exposed to ambient air and an interior surface defining a combustion chamber for containing said solid fuel, the enclosure having an enclosure body having front and rear openings with a front panel and a rear panel fitted into the front and rear ends defining joints therebetween, and structurally reinforcing the metal layer and sealing said joints by coating the interior surface of the enclosure with heat and abrasion resistant anti-oxidant layer having a co-efficient of thermal expansion not substantially greater than the co-efficient of thermal expansion of the metal layer.

* * * * *